US012298054B2

(12) United States Patent
Lv et al.

(10) Patent No.: US 12,298,054 B2
(45) Date of Patent: May 13, 2025

(54) VACUUM STORAGE DEVICE AND REFRIGERATOR

(71) Applicants: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

(72) Inventors: Peng Lv, Qingdao (CN); Hao Zhang, Qingdao (CN); Jiaming Li, Qingdao (CN); Wenchun Wang, Qingdao (CN)

(73) Assignees: CHONGQING HAIER REFRIGERATION ELECTRIC APPLIANCE CO., LTD., Chongqing (CN); QINGDAO HAIER REFRIGERATOR CO., LTD., Qingdao (CN); HAIER SMART HOME CO., LTD., Qingdao (CN)

( * ) Notice: Subject to any disclaimer, the term of this patent is extended or adjusted under 35 U.S.C. 154(b) by 80 days.

(21) Appl. No.: 18/015,949

(22) PCT Filed: Jun. 18, 2021

(86) PCT No.: PCT/CN2021/100885
§ 371 (c)(1),
(2) Date: Jan. 12, 2023

(87) PCT Pub. No.: WO2022/012266
PCT Pub. Date: Jan. 20, 2022

(65) Prior Publication Data

US 2023/0272961 A1 Aug. 31, 2023

(30) Foreign Application Priority Data

Jul. 13, 2020 (CN) ..... 202010670611.2

(51) Int. Cl.
*F25D 17/04* (2006.01)

(52) U.S. Cl.
CPC ..... *F25D 17/042* (2013.01); *F25D 2317/043* (2013.01)

(58) Field of Classification Search
CPC . F25D 17/042; F25D 25/025; F25D 2317/043
See application file for complete search history.

(56) References Cited

U.S. PATENT DOCUMENTS 5,095,717 A * 3/1992 Germi ..... F25D 17/042 417/313
2018/0177322 A1* 6/2018 Kim ..... A47J 27/092
(Continued)

FOREIGN PATENT DOCUMENTS

CN 2900399 Y 5/2007
CN 201220813 Y 4/2009
(Continued)

*Primary Examiner* — Lionel Nouketcha
(74) *Attorney, Agent, or Firm* — Cheng-Ju Chiang

(57) ABSTRACT

The present invention provides a vacuum storage device and a refrigerator. The vacuum storage device comprises a housing, a cover, an evacuation assembly, a pressure relief assembly and an adjuster; the pressure relief assembly comprises a pressure relief hole, a sealing plug covering the pressure relief hole in a natural state, and a pressure relief element having a pressure relief slider; the adjuster drives the pressure relief slider to get close to or away from the sealing plug without being affected by an external force. The structure is simple and the sealing effect is better.

11 Claims, 12 Drawing Sheets

(56) References Cited

U.S. PATENT DOCUMENTS

| | | | | |
|---|---|---|---|---|
| 2020/0033048 | A1* | 1/2020 | Zhang | F25D 23/087 |
| 2020/0047973 | A1* | 2/2020 | Liu | F25D 17/042 |

FOREIGN PATENT DOCUMENTS

| | | | | | |
|---|---|---|---|---|---|
| CN | 101774451 | A | | 7/2010 | |
| CN | 101957119 | A | | 1/2011 | |
| CN | 103486817 | A | | 1/2014 | |
| CN | 204043274 | U | | 12/2014 | |
| CN | 108895757 | A | | 11/2018 | |
| CN | 111207553 | A | * | 5/2020 | |
| JP | 2004251599 | A | * | 9/2004 | |
| KR | 10-2014-0036578 | A | | 3/2014 | |
| WO | WO-2007135046 | A1 | * | 11/2007 | A47J 47/10 |

* cited by examiner

VACUUM STORAGE DEVICE AND REFRIGERATOR

CROSS REFERENCE TO RELATED APPLICATIONS

The present invention is a 35 U.S.C. § 371 National Phase conversion of International (PCT) Patent Application No. PCT/CN2021/100885, filed on Jun. 18, 2021, which claims benefit of Chinese Application No. 202010670611.2, filed on Jul. 13, 2020, the disclosure of which is incorporated by reference herein. The PCT International Patent Application was filed and published in Chinese.

TECHNICAL FIELD

The present invention relates to the field of refrigerating devices, and particularly to a vacuum storage device and a refrigerator.

BACKGROUND

In conventional fresh-keeping technologies of refrigerators, use of a vacuum storage device (namely, a vacuum storage drawer) is the most efficient way of achieving the vacuum fresh-keeping technologies in the refrigerator. Its principle is disposing an evacuation device in a closed box. When the box is in a closed state, the evacuation device evacuates the interior of the box so that the interior of the box forms a low-pressure vacuum state, thereby effectively reducing the probability of oxidation, deterioration and mildew of articles, reducing the flow of air over the surfaces of the articles and thereby prolonging the fresh-keeping duration of the articles.

It may be understood that before the articles are taken out, a pressure relief operation needs to be performed for the box in the vacuum state. Generally, the box comprises a housing and a cover sealingly cooperating with the housing. The cover is provided with a pressure relief hole and a handle, and the handle is provided with a sealing plug cooperating with the pressure relief hole. When the handle is turned, the sealing plug disengages from the pressure relief hole, thereby achieving the release of pressure. However, dislocation is prone to occur between the sealing plug and the pressure relief hole, and affects the sealing effect.

In view of the above, it is necessary to provide a new vacuum storage device and a refrigerator to solve the above problems.

SUMMARY

An object of the present invention is to provide a vacuum storage device and a refrigerator.

To achieve the above object, the present invention employs the following technical solutions: A vacuum storage device, comprising a housing with a storage cavity, a cover cooperating with the housing to open or close the storage cavity, a seal disposed between the housing and the cover, an evacuation assembly disposed on the housing or the cover, a pressure relief assembly for relieving the pressure in the storage cavity, and an adjuster located on the housing or the cover, the pressure relief assembly comprises:

- a pressure relief hole communicated with the storage cavity,
- a sealing plug having a sealing portion for sealing the pressure relief hole;

- a pressure relief element comprising a fixed base, a pressure relief slider slidingly attached to the fixed base, where an end of the pressure relief slider close to the sealing plug is provided with an insertion portion enabling the sealing portion to open the pressure relief hole at an edge of the sealing portion, and both the pressure relief element and the pressure relief hole are located on the cover or the housing;
- the adjuster drives the pressure relief slider to get close to or away from the sealing plug.

In another exemplary aspect of the present disclosure, the sealing plug further comprises a fixing portion fixed to the cover or the housing provided with the pressure relief hole, and the sealing portion is connected with the fixing portion; the pressure relief slider and the pressure relief hole are on the same side of the fixing portion.

In another exemplary aspect of the present disclosure, a thickness of the insertion portion gradually increases from an end of the insertion portion close to the sealing portion to the other end away from the sealing portion.

In another exemplary aspect of the present disclosure, a first guide block is disposed on the pressure relief slider, and the adjuster comprises:

- a handle;
- a rotating shaft fixed with the handle and provided with a second guide block cooperating with the first guide block, where when the handle drives the rotating shaft to rotate, the second guide block and the first guide block cooperate with each other to drive the pressure relief slider to move towards the sealing plug;
- a first driver for resetting disposed between the pressure relief slider and the fixed base, where after the pressure relief slider moves towards the sealing plug, the first reset driver drives the pressure relief slider to return.

In another exemplary aspect of the present disclosure, the fixed base has a guide structure extending towards the sealing plug, and a connecting portion located at an end of the guide structure away from the sealing plug; the pressure relief slider has a sliding structure cooperating with the guide structure to guide the pressure relief slider to get close to or away from the sealing plug, the first driver is an elastic member, and both ends of the elastic member are respectively fixed on the connecting portion and the sliding structure.

In another exemplary aspect of the present disclosure, the guide structure is a guide groove, and at least part of the sliding structure can extend into the guide groove; or, the guide structure is a guide bar, and the sliding structure has a guide groove cooperating with the guide bar.

In another exemplary aspect of the present disclosure, the cover or housing provided with the adjuster is provided with a rotation groove for receiving part of the rotating shaft, a handle cavity communicated with the rotation groove and configured to receive the handle, and a stopper cooperating with the rotation groove and configured to prevent the rotating shaft from disengaging.

In another exemplary aspect of the present disclosure, a filter is disposed at a position on an inner side of the vacuum storage device corresponding to the pressure relief hole.

In another exemplary aspect of the present disclosure, the pressure relief assembly and the adjuster are both disposed on the cover, and the pressure relief element and the adjuster are located on a side of the cover away from the housing.

In another exemplary aspect of the present disclosure, the adjuster is disposed on the cover; the vacuum storage device further comprises a locking assembly that locks the cover with the housing, the locking assembly comprises a first locking member disposed on the housing, a second locking member disposed on the cover and cooperating with the first locking member, and the adjuster drives the second locking member to unlock from the first locking member while driving the pressure relief slider to get close to the sealing plug.

In another exemplary aspect of the present disclosure, the pressure relief slider is provided with a first guide block, and the adjuster comprises:

a locking slider slidably connected to the cover and fixed with the second locking member, and the locking slider is provided with a first guide portion;

a handle;

a rotating shaft fixed with the handle, the rotating shaft being provided with a second guide portion cooperating with the first guide portion, and a second guide block cooperating with the first guide block; when the handle drives the rotating shaft to rotate, the second guide portion and the first guide portion cooperate with each other to drive the locking slider to drive the second locking member away from the first locking member, and the second guide block and the first guide block cooperate each other to drive the pressure relief slider to get close to the sealing plug.

To achieve the above object, the present invention further provides a refrigerator, comprising a refrigeration compartment and the above-mentioned vacuum storage device located in the refrigeration compartment.

Advantageous effects of the present invention are as follows: in the vacuum storage device in the present invention, the pressure relief slider is driven so that the insertion portion of the pressure relief slider is inserted into the edge of the sealing portion, thereby opening the pressure relief hole to realize pressure relief. The sealing portion covers the pressure relief hole in its natural state and is not affected by an external force. That is to say, only when the pressure relief is needed and the adjuster is operated will the sealing portion open the pressure relief hole to realize the pressure relief, with a simple structure and a good sealing effect.

DETAILED DESCRIPTION

Figure 1:
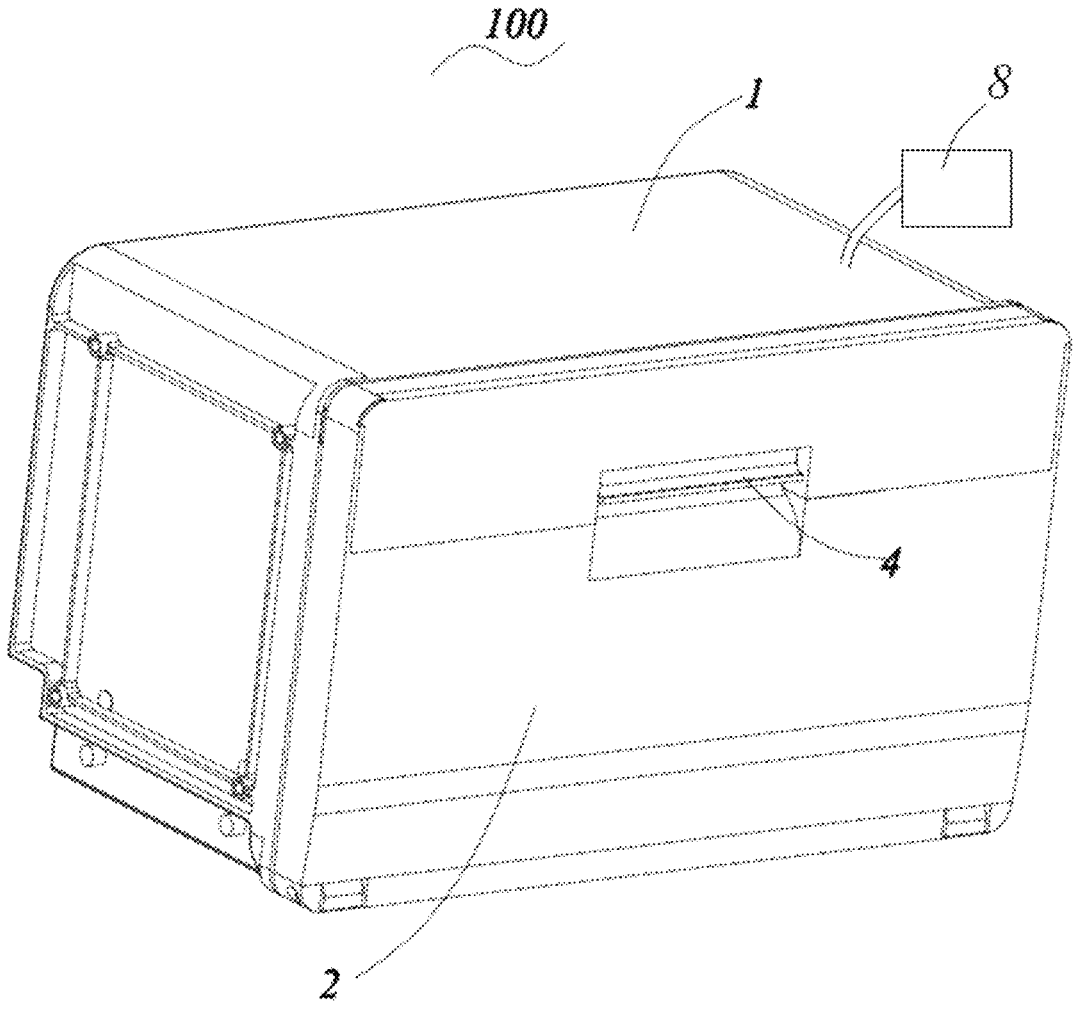
FIG. 1 is a structural schematic view of a vacuum storage device in the present invention.

The present invention will be described in detail in conjunction with specific embodiments shown in the figures. FIG. 1 through FIG. 12 show preferred embodiments of the present invention. However, these embodiments are not intended to limit the present invention. Structural, methodological or functional equivalent variations or substitutions made by those having ordinary skill in the art according to these embodiments are all included in the protection scope of the present invention.

In the depictions of the present invention, it needs to be appreciated that in the present invention the side where the opening of the housing lies is taken as "front", and other words indicating orientation or positional relationship such as "rear", "up", "down", "left" and "right" are all with reference to "front". Furthermore, these words indicating the orientation or positional relationship are only intended to help describe the present invention or simplify the depictions, and not to indicate or imply that the designated device or element must have a specific orientation and must be configured and operated with specific orientations, and therefore cannot construed as limiting the present invention.

In the present description, it needs to be appreciated that unless otherwise explicitly specified and defined, the terms such as "connect" should be understood in a broad sense, for example, "connect" may mean direct connection or indirect connection via an intermediate medium, or may mean fixed connection or detachable connection or integral connection. Those having ordinary skill in the art may understand that the specific meanings of the above terms in the present invention should be understood according to actual situations.

Referring to FIG. 1 through FIG. 12, the present invention provides a vacuum storage device 100, comprising a housing 1 with a storage cavity, a cover 2 cooperating with the housing 1 to open or close the storage cavity, a seal 7 disposed between the housing 1 and the cover 2, an evacuation assembly 8 disposed on the housing 1 or the cover 2, and is used to draw gas away from the storage cavity to provide a low pressure condition in the storage cavity, a pressure relief assembly 3 for relieving the pressure in the storage cavity, and an adjuster 4 located on the housing 1 or the cover 2, wherein the adjuster 4 drives the pressure relief assembly 3 to relieve pressure, so that the cover 2 can be opened.

It should be appreciated that respective structures, mounting positions and mounting manners of the seal 7 and the evacuation assembly 8 of the vacuum storage device 100 in the present invention may employ similarly to or same as any conventional vacuum storage device (Referring to the above descriptions of Paragraph [0002] for more details). Detailed depictions will not be presented any more here.

Specifically, an opening is provided on a front side of the housing 1, and the cover 2 cooperates with the opening to open or close the opening.

In the present embodiment, a lower end of the cover 2 is rotationally connected to the housing 1. Certainly, the connection manner is not limited to this.

Furthermore, as shown in FIG. 2 through FIG. 10, the pressure relief assembly 3 comprises a pressure relief hole 31 communicated with the storage cavity, a sealing plug 32 having a sealing portion 322, and a pressure relief element 33 for causing the sealing plug 32 to open the pressure relief hole 31. The adjuster 4 drives the pressure relief element 33 to get close to or away from the sealing plug 32. When the adjuster 4 drives the pressure relief element 33 to get close to the sealing plug 32, the sealing plug 32 can open the pressure relief hole 31 to realize pressure relief, so that the cover 2 can be opened.

It may be appreciated that the pressure relief hole 31, the sealing plug 32 and the pressure relief element 33 are simultaneously located on the cover 2 or the housing 1.

Specifically, in the present embodiment, detailed depictions are presented by taking an example in which the pressure relief hole 31, the sealing plug 32, the pressure relief element 33 and the adjuster 4 are all disposed on the cover 2. Certainly, the present invention is not limited to this in this regard. It may be appreciated that the pressure relief assembly 3 and the adjuster 4 may be respectively disposed on the cover 2 and the housing 1, as long as the pressure relief element 33 can be driven by the adjuster 4 to get close to or away from the sealing plug 32.

Specifically, the cover 2 comprises a cover body 21 with a mounting portion, and a decorative cover body 22 cooperating with the mounting portion. The pressure relief hole 31, the sealing plug 32, the pressure relief element 33, and the adjuster 4 are all disposed at the mounting portion. The decorative cover body 22 is snap-fitted on the cover body 21 and is located on a front side of the mounting portion to enhance the effect of the appearance of the cover 2.

It may be appreciated that the cover body 21 is an integrally injection-molded member, and the pressure relief hole 31 is disposed through the mounting portion to communicate the interior with the exterior of the storage cavity.

In the embodiment in which the pressure relief hole 31, the sealing plug 32, the pressure relief element 33 and the adjuster 4 are all disposed on the cover 2, the sealing plug 32, the pressure relief element 33 and the adjuster 4 are all located on a side of the cover body 21 away from the housing 1, that is, the sealing plug 32, the pressure relief element 33 and the adjuster 4 are all located on the front side of the cover body 21 to facilitate the user's operation.

The sealing plug 32 is provided with a fixing portion 321 fixedly connected to the cover 2 and a sealing portion 322 connected to a circumferential edge of the fixing portion 321. After the sealing plug 32 is fixed to the cover 2, the sealing portion 322 covers and seals the pressure relief hole 31 on the front side of the mounting portion. It may be understood that the sealing portion 322 covers the pressure relief hole 31 in its natural state without being affected by an external force. That is to say, only when the pressure relief is needed and after the adjuster 4 is operated, will the sealing portion 322 open the pressure relief hole 31 to realize the pressure relief, with a simple structure and a good sealing effect.

It may be understood that the sealing plug 32 has certain elasticity, for example, the sealing plug 32 is a rubber plug.

The pressure relief element 33 comprises a fixed base 331 fixed on the mounting portion and a pressure relief slider 332 slidingly connected to the fixed base 331. An end of the pressure relief slider 332 close to the sealing plug 32 is provided with an insertion portion 3321. The adjuster 4 can drive the insertion portion 3321 to be inserted between the sealing portion 322 and the mounting portion at an edge of the sealing portion 322 to open the pressure relief hole 31, that is, the adjuster 4 drives the pressure relief slider 332 to get close to the sealing plug 32 so that the insertion portion 3321 is inserted between the sealing portion 322 and the mounting portion at the edge of the sealing portion 322. After the pressure relief slider 332 moves towards the sealing plug 32, the adjuster 4 drives the pressure relief slider 332 to get away from the sealing plug 32. The sealing plug 32 seals the pressure relief hole 31 under the action of its own elastic recovery force, with a good sealing effect.

Specifically, a pressure relief sliding groove 3311 is recessed on a side of the fixed base 331 facing toward the mounting portion. After the fixed base 331 is mounted to the mounting portion, the fixed base 331 and the mounting portion together form a sliding cavity in which the pressure relief slider 332 slides, so that the pressure relief slider 332 can only move against the mounting portion along the pressure relief sliding groove 3311, thereby enhancing the stability of its movement, and simplifying the structure of the pressure relief element 33.

Furthermore, the pressure relief slider 332 and the pressure relief hole 31 are located on the same side of the fixing portion 321. Therefore, the adjuster 4 only needs to drive the pressure relief slider 332 to move to the insertion portion 3321 to lift the edge of the sealing portion 322, which facilitates adjustment and shortens the adjusting path.

Furthermore, a thickness of the insertion portion 3321 gradually increases from an end of the insertion portion 3321 close to the sealing portion 322 to the other end away from the sealing portion 322, that is, the front side of the insertion portion 3321 is an inclined surface extending inclinedly forward from the end close to the sealing portion 322 to the other end away from the sealing portion 322, so that the insertion portion 3321 is inserted between the sealing portion 322 and the mounting portion, and the sealing portion 322 is lifted to open the pressure relief hole 31.

Furthermore, the adjuster 4 comprises a handle 41, a rotating shaft 42 fixed with the handle 41, and a first driver 43 for resetting which drives the pressure relief slider 332 away from the sealing plug 32.

Specifically, the handle 41 and the rotating shaft 42 are integrally formed, enhancing the stability in adjusting the adjuster 4. Certainly, the present invention is not limited to this in this regard.

A first guide block 3322 is disposed on the pressure relief slider 332, and a second guide block 421 cooperating with the first guide block 3322 is disposed on the rotating shaft 42. When the handle 41 drives the rotating shaft 42 to rotate, the second guide block 421 cooperates with the first guide block 3322 to drive the pressure relief slider 332 to move towards the sealing plug 32 until the insertion portion 3321 is inserted between the sealing portion 322 and the mounting portion, to open the pressure relief hole 31 and achieve the pressure relief. The structure is simple and the operation is convenient.

Specifically, the first guide block 3322 and the second guide block 421 are provided with guide ramps that cooperate with each other, so that when the handle 41 drives the rotating shaft 42 to rotate, the second guide block 421 rotates, and in cooperation with the guide ramp of the first guide block 3322, drives the pressure relief slider 332 to move towards the sealing plug 32, thereby achieving the pressure relief.

The first driver 43 is disposed between the pressure relief slider 332 and the fixed base 331. After the handle 41 is released, the first driver 43 drives the pressure relief slider 332 away from the sealing plug 32. The sealing portion 322 covers and seals the pressure relief hole 31 under the action of its elastic recovery force. At the same time, while the pressure relief slider 332 gets away from the sealing plug 32, the first guide block 3322 and the second guide block 421 cooperate with each other to drive the handle 41 to reset.

Furthermore, the first driver 43 is an elastic member, for example, may be set as a spring. The cost is low and the structure is simple. Certainly, the present invention is not limited to this in this regard.

Furthermore, the fixed base 331 has a guide structure 3312 extending toward the sealing plug 32, and the pressure relief slider 332 has a sliding structure 3323 cooperating with the guide structure 3312 to guide the pressure relief slider 332 to get close to or away from the sealing plug 32, so as to guide the pressure relief slider 332 to get close to or away from the sealing plug 32, thereby enhancing the stability of the movement of the pressure relief slider 332.

In a specific embodiment, the guide structure 3312 is a guide groove, and at least part of the sliding structure 3323 can extend into the guide groove to guide and limit the pressure relief slider 332. Certainly, the present invention is not limited to this in this regard. In other embodiments, the guide structure 3312 may also be set as a guide bar, and the sliding structure 3323 has a guide groove cooperating with the guide bar, which will not be detailed any more.

Furthermore, the fixed base 331 is also provided with a connecting portion 3313 located at an end of the guide structure 3312 away from the sealing plug 32. In the embodiment where the first driver 43 is an elastic member, both ends of the elastic member are respectively fixed on the connecting portion 3313 and the sliding structure 3323, thereby simplifying the connecting structure of the first driver 43 and reducing the cost.

Figure 9:
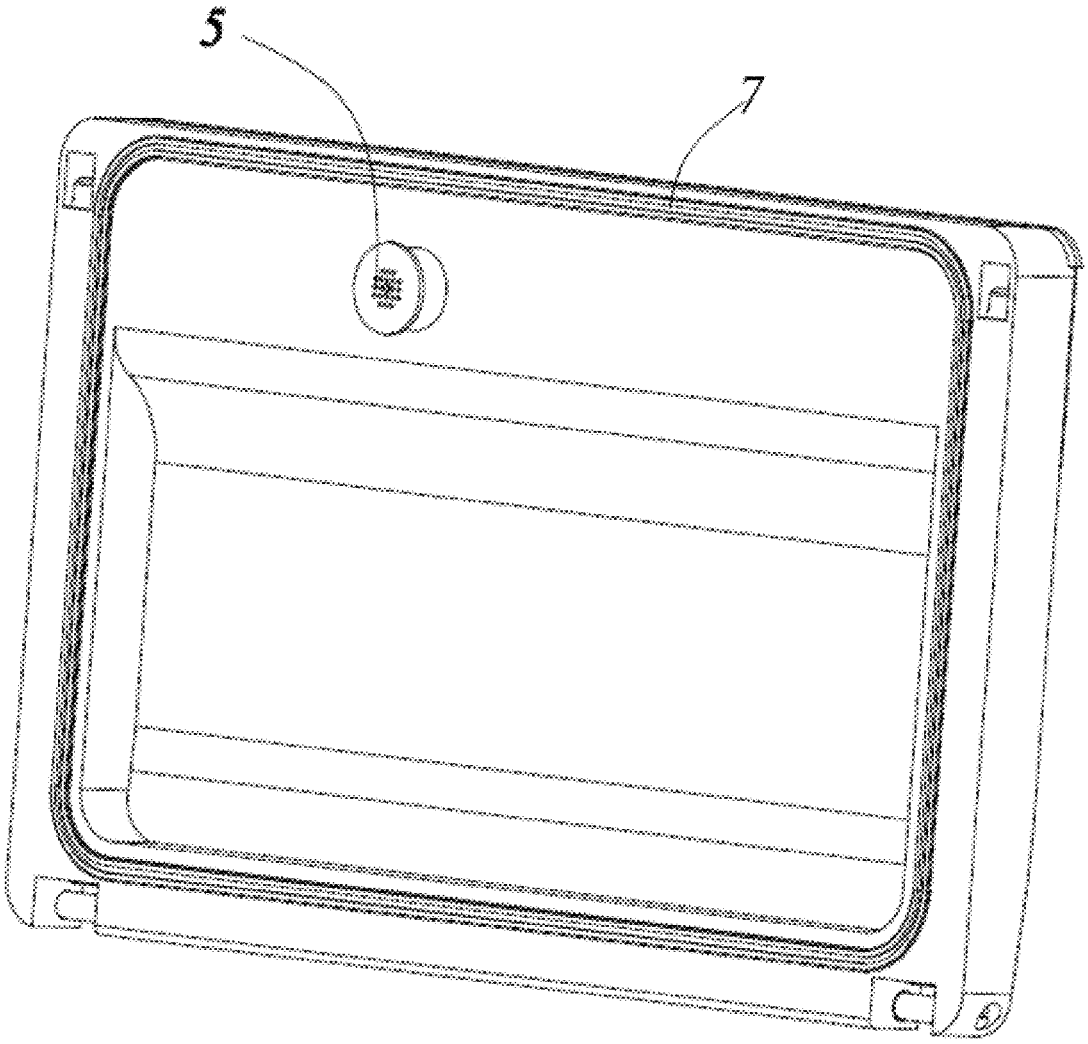
FIG. 9 is a structural schematic view of a cover in FIG. 1.
Figure 10:
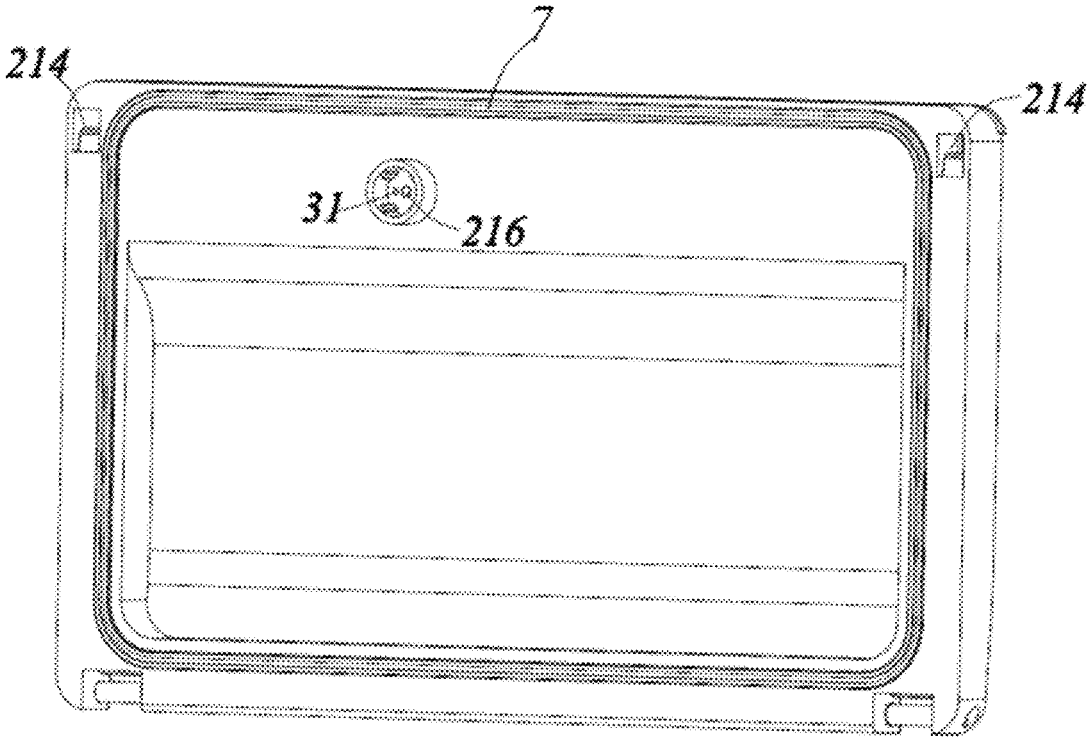
FIG. 10 is a structural schematic view of the cover of FIG. 8 with a filter being removed.

Furthermore, as shown in FIG. 9, a filter 5 is disposed at a position on an inner side of the vacuum storage device 100 corresponding to the pressure relief hole 31, to prevent impurities such as dust from entering the storage cavity from the pressure relief hole 31 and polluting the articles in the storage cavity, and to prevent lighter and smaller articles (such as tea, etc.) in the storage cavity from shielding the pressure relief hole 31 and affecting the pressure relief.

In the embodiment where the pressure relief hole 31 is disposed on the cover 2, the filter 5 is mounted on a side of the cover 2 facing towards the housing 1.

Figure 2:
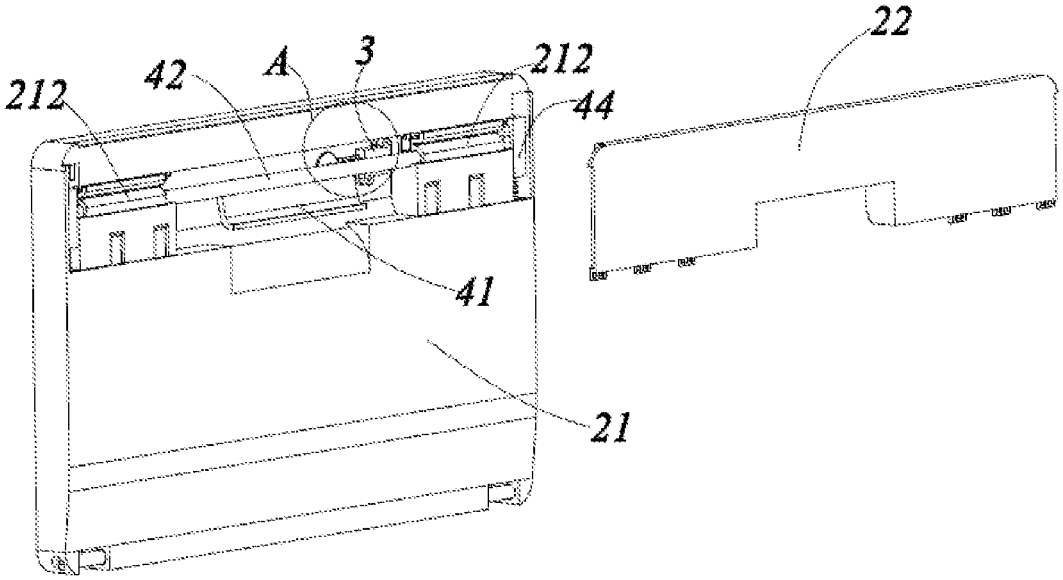
FIG. 2 is an exploded view of a cover in FIG. 1.
Figure 3:
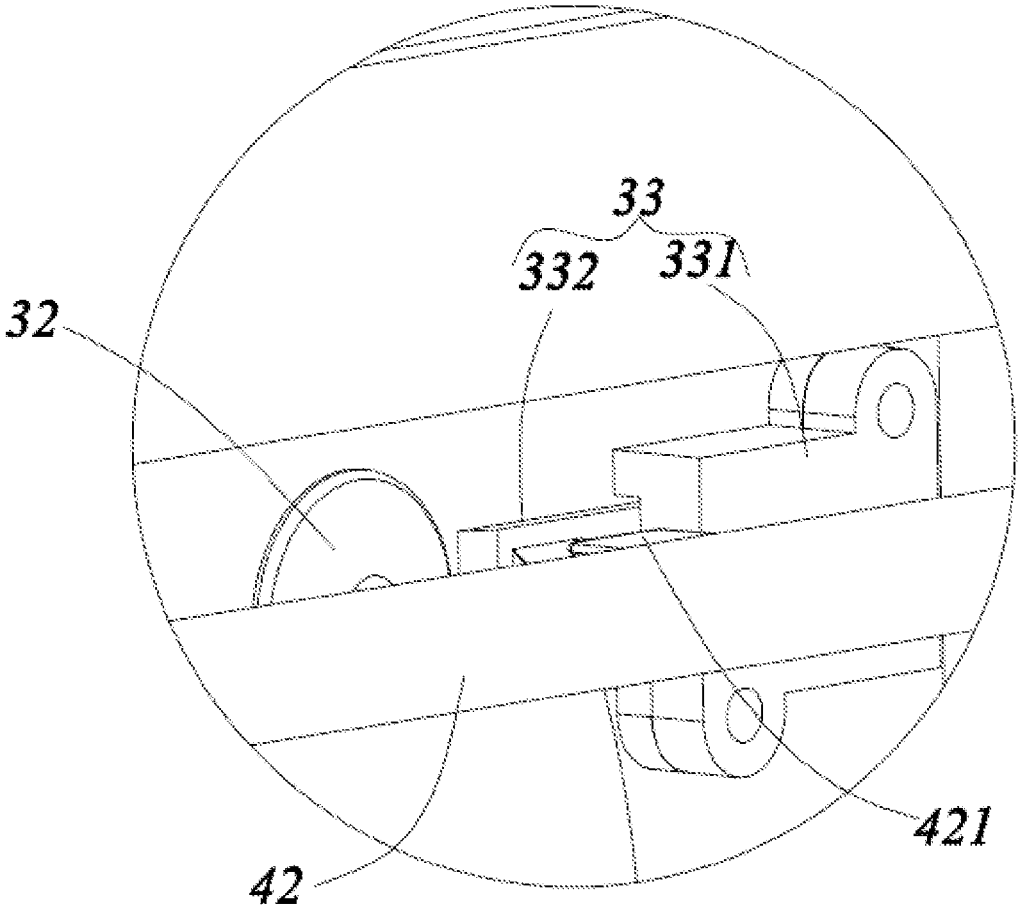
FIG. 3 is an enlarged view of position A in FIG. 2.
Figure 4:
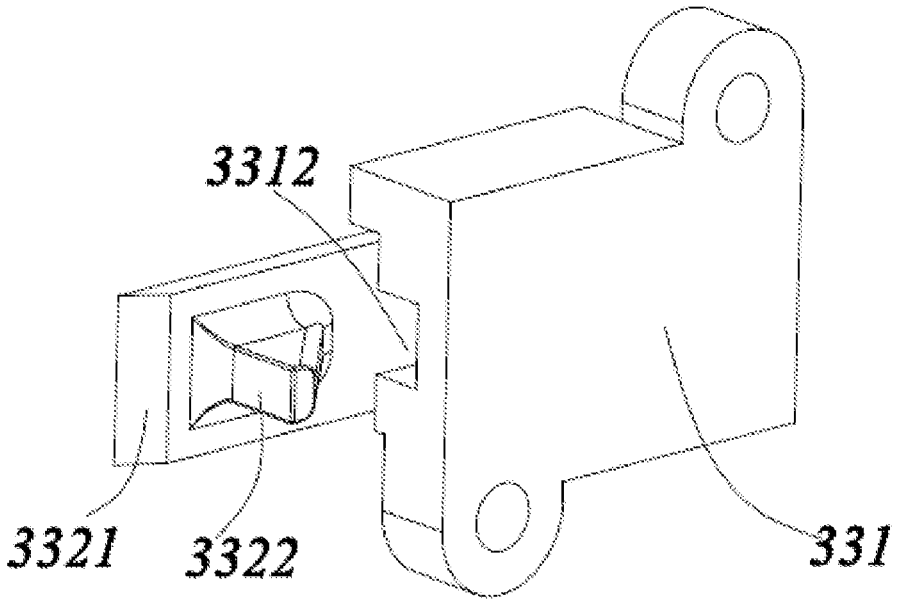
FIG. 4 is a structural schematic view of a pressure relief element in FIG. 3.
Figure 5:
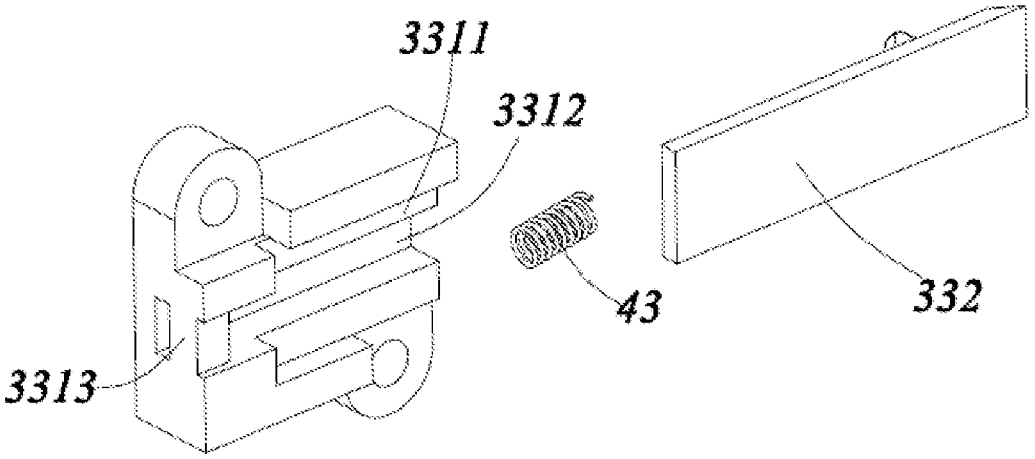
FIG. 5 is an exploded view of FIG. 4.
Figure 6:
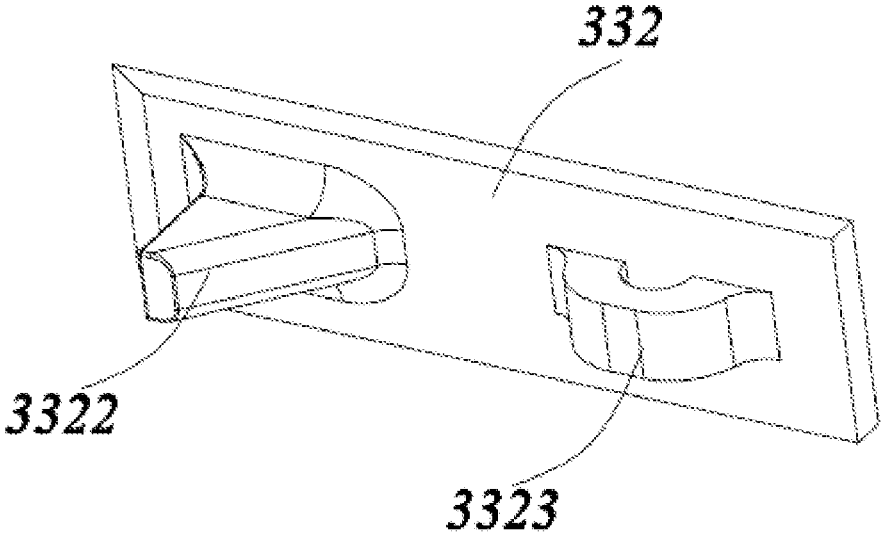
FIG. 6 is a structural schematic view of a pressure relief slider in FIG. 4.
Figure 7:
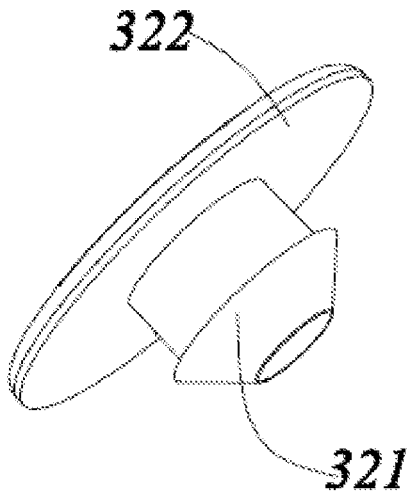
FIG. 7 is a structural schematic view of a sealing plug in FIG. 3.
Figure 8:
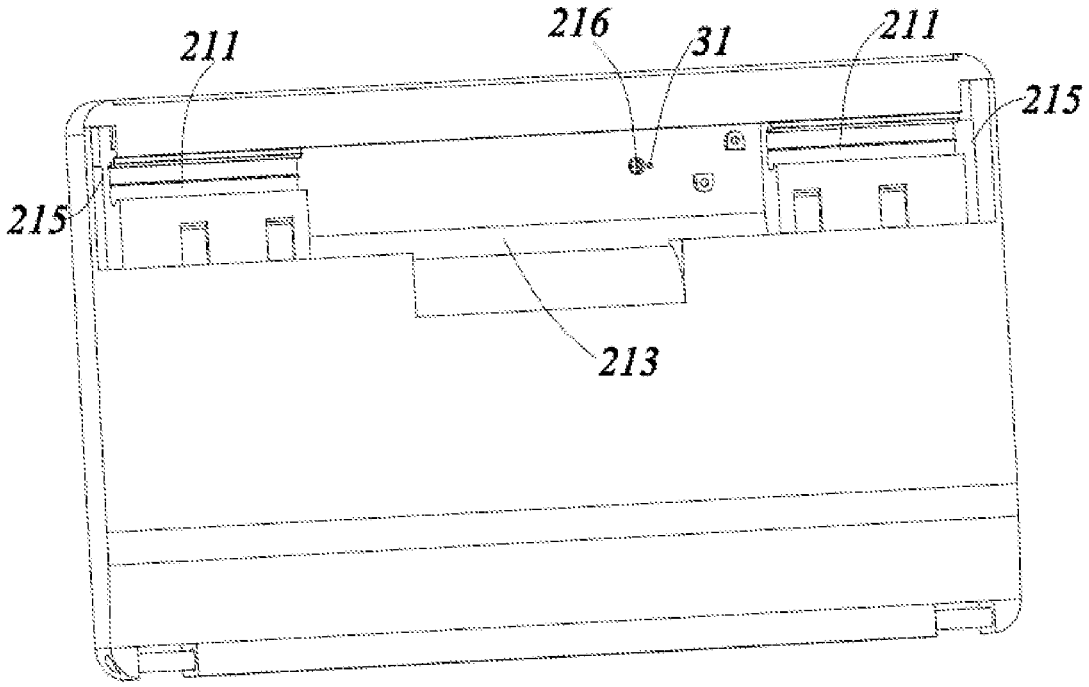
FIG. 8 is a structural schematic view of a cover body in FIG. 2.

Furthermore, as shown in FIG. 2 and FIG. 8, the mounting portion is provided with a rotation groove 211 for receiving part of the rotating shaft 42, a stopper 212 for preventing the rotating shaft 42 from disengaging from the rotation groove 211, and a handle cavity 213 communicated with the rotation groove 211 and configured to receive the handle 41. The decorative cover body 22 covers part of the handle cavity 213, so that the user can operate the handle 41.

The pressure relief element 33 is mounted at a position of the mounting portion corresponding to the second guide block 421. The positon and size of the rotation groove 211 may be set as long as the rotation groove 211 does not interfere with the pressure relief slider 332 and does not affect the fitting between the second guide block 421 and the first guide block 3322.

It may be understood that the rotation groove 211 and the handle cavity 213 are both formed concavely rearward from a front side of the cover body 21, that is, a front side of the rotation groove 211 is provided with a mounting port for mounting the rotating shaft 42, and the stopper 212 is used to cover the mounting port to prevent the rotating shaft 42 from disengaging from the mounting port.

In a specific embodiment, the stopper 212 is snap-fitted on the mounting portion. After the stopper 212 is mounted on the mounting portion, the stopper 212 covers the mounting port to prevent the rotating shaft 42 from disengaging from the mounting port and enhance the stability of the adjuster 4; certainly, the present invention is not limited to this in this regard.

Figure 11:
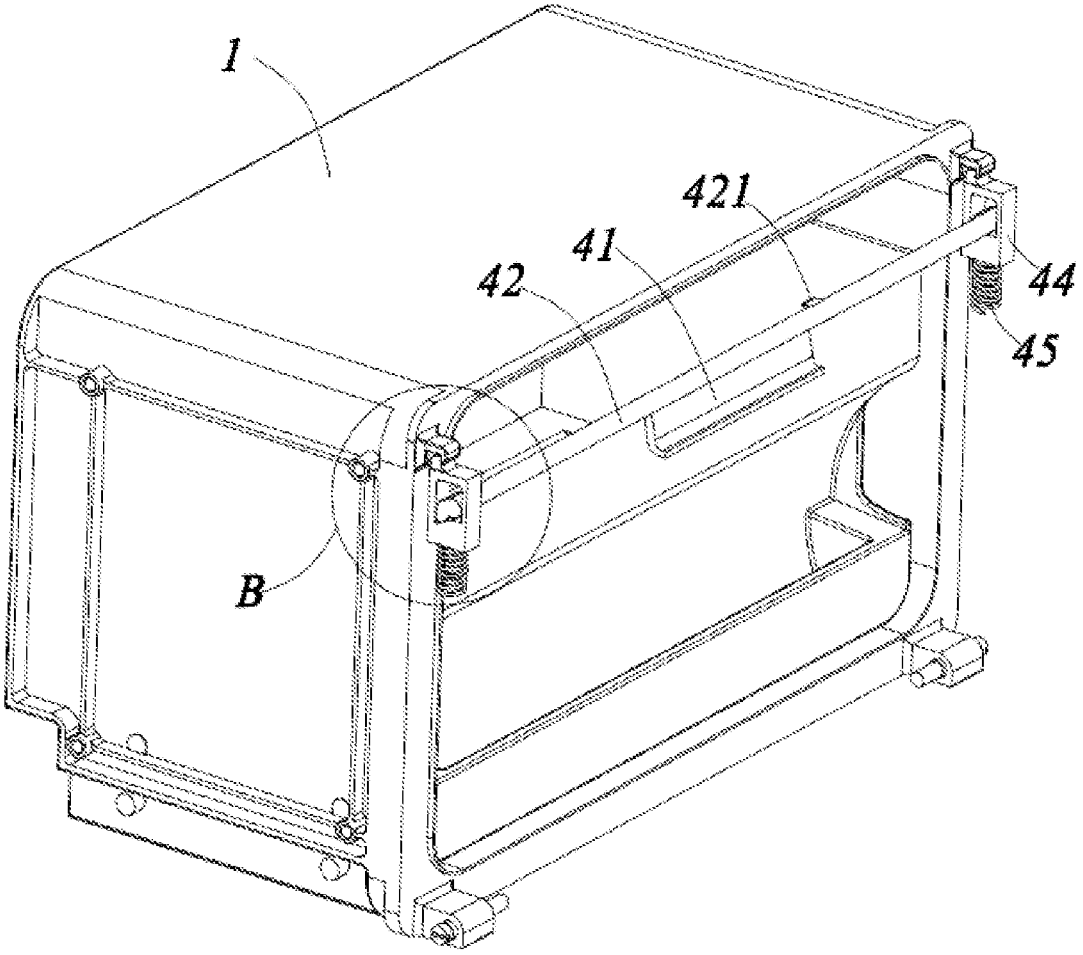
FIG. 11 is a structural schematic view of the vacuum storage device in FIG. 1 with the cover being removed.
Figure 12:
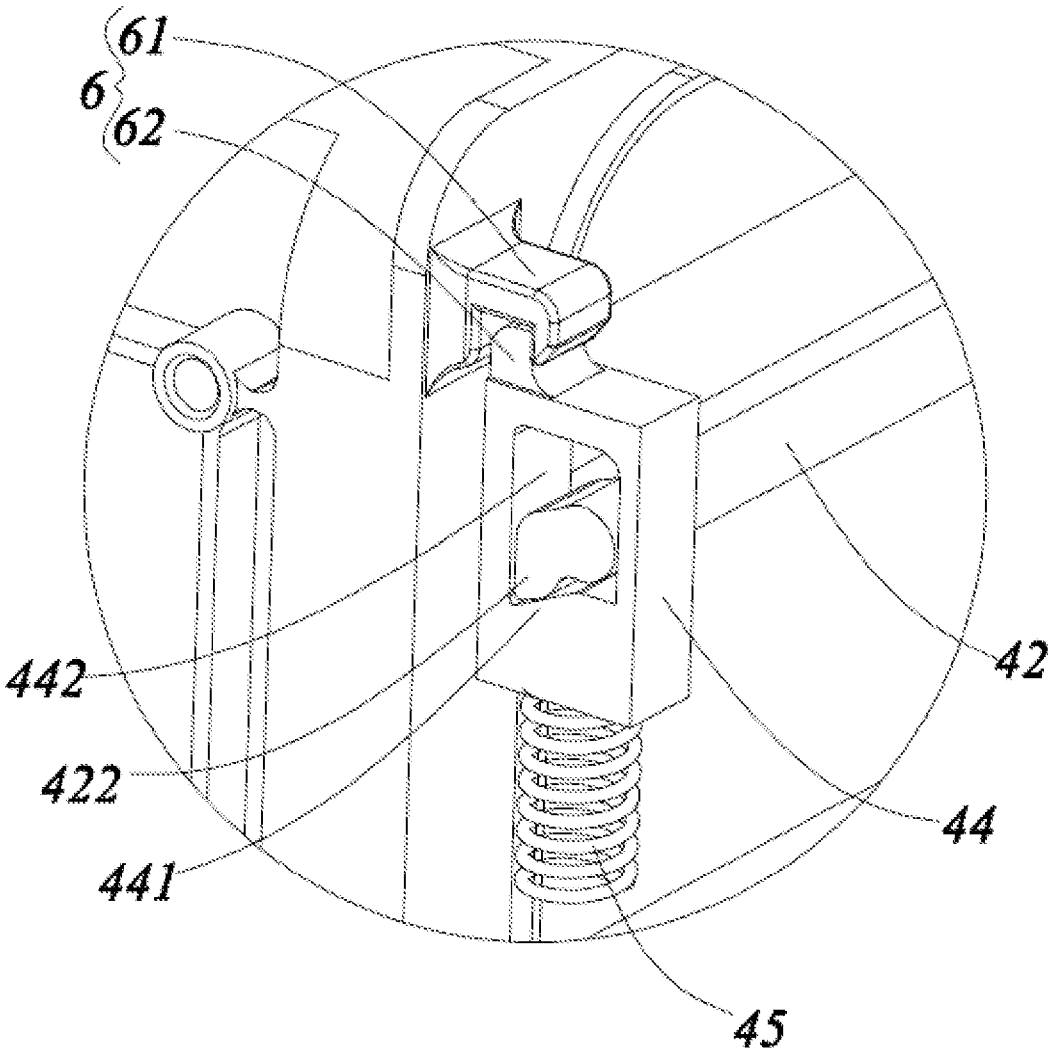
FIG. 12 is an enlarged view of position B in FIG. 11.

Furthermore, referring to FIG. 11-FIG. 12, in an embodiment in which the adjuster 4 is disposed on the cover 2, the vacuum storage device 100 further comprises a locking assembly 6 that locks the cover 2 with the housing 1, thereby enhancing the sealing performance between the cover 2 and the housing 1.

The locking assembly 6 comprises a first locking member 61 disposed on the housing 1, a second locking member 62 disposed on the cover 2 and cooperating with the first locking member 61. The adjuster 4 drives the second locking member 62 to unlock from the first locking member 61 while driving the pressure relief slider 332 to get close to the sealing plug 32, thereby simplifying the structure of the adjuster 4. In addition, the cover 2 can be unlocked while pressure is released, which simplifies the operation and facilitates use by the user.

In the present embodiment, the second locking member 62 is slidingly connected to the cover 2. The second locking member 62 has a locked position where the second locking member 62 is locked with the first locking member 61 and an unlocked position where the second locking member 62 separates from the first locking member 61, i.e., the adjuster 4 is configured to drive the second locking member 62 to move linearly between the locked position and the unlocked position; Certainly, the present invention is not limited to this in this regard. In other embodiments, the adjuster 4 can also be configured to drive the second locking member 62 to rotate to move between the locked position and the unlocked position. The structure that the adjuster 4 drives the second locking member 62 to rotate to move between the locked position and the unlocked position is a structure in the prior art, and will not be described in detail any more here.

In the present embodiment, the number of the first locking members 61 is two, and the two first locking members 61 are disposed on left and right sides of the housing 1, respectively, thereby enhancing the sealing effect between the cover 2 and the housing 1.

In the embodiment in which the two first locking members 61 are disposed on the left and right sides of the housing 1, respectively, the second locking member 62 is slidingly connected to the cover 2 in an up-down direction, so that during the movement between the locked position and the unlocked position, the second locking member 62 will not interfere with other structures in the refrigeration compartment in which the storage device is disposed, thereby enhancing the universality of the storage device; certainly, the present invention is not limited to this in this regard.

In a specific embodiment, the first locking member 61 is a hook protruding toward the cover 2, and the second locking member 62 is a catching block slidingly connected to the housing 1. Certainly, the present invention is not limited to this in this regard. The specific fitting mode between the first locking member 61 and the second locking member 62 can only facilitate the linear movement of the second locking member 62 between the locked position and the unlocked position.

In the embodiment where the first locking member 61 is a hook protruding toward the cover 2, the cover 2 is provided with a through hole 214 into which the first locking member 61 extends.

Furthermore, the adjuster 4 further comprises a locking slider 44 slidably connected to the cover 2, and a second driver 45 for resetting which is connected between the locking slider 44 and the cover 2. The locking slider 44 is fixed to the second locking member 62, the locking slider 44 is provided with a first guide portion 441, and a second guide portion 422 cooperating with the first guide portion 441 is disposed at an end of the rotating shaft 42 away from the handle 41. When the handle 41 drives the rotating shaft 42 to rotate, the second guide portion 422 and the first guide portion 441 cooperate each other to drive the locking slider 44 to drive the second locking member 62 to move towards the unlocked position. At the same time, the second guide block 421 and the first guide block 3322 cooperate each other to guide the pressure relief slider 332 to get close to the sealing plug 32, so as to unlock the cover 2 while releasing the pressure, thereby simplifying the operation and facilitating user's use.

In the embodiment in which the two first locking members 61 are disposed on the left and right sides of the housing 1 respectively, and the second locking member 62 is slidingly connected to the cover 2 in an up-down direction, the handle 41 is located in the middle of the cover 2 in a left-right direction, the rotating shaft 42 extends in the left-right direction, and both ends of the rotating shaft 42 cooperate with two locking sliders 44, so as to synchronously drive the two locking sliders 44 to move towards the unlocked position.

Furthermore, the first guide portion 441 has a first guide surface extending towards the housing 1 and the side where the unlocked position of the second locking member 62 is located, and the second guide portion 422 has a second guide surface cooperating with the first guide surface. When the handle 41 rotates, the first guide surface cooperates with the second guide surface to drive the second locking member 62 to move in an unlocking direction.

It may be understood that in the embodiment in which the second locking member 62 is slidably connected to the cover 2 in an up-down direction, and the unlocked position is located below the locked position, the first guide surface extends downward and backward from its upper end, and the second locking member 62 is fixed to the upper end of the locking slider 44.

Furthermore, the second guide surface is an arcuate surface. In an initial stage of the rotation of the handle 41, the second guide portion 422 is easier to move relative to the first guide portion 441, and a contact area between the second guide portion 422 and the first guide portion 441 is increased during the rotation of the handle 41, so that the relative movement between the first guide portion 441 and the second guide portion 422 is relatively gentle, and the stability of the adjuster 4 is enhanced.

Furthermore, the locking slider 44 is provided with a perforation 442 through which the rotating shaft 42 runs, and the first guide portion 441 is disposed in the perforation 442, that is, an end of the rotating shaft 42 is located in the perforation 442, and the second guide portion 422 and the first guide portion 441 fit with each other to enhance the stability of the fitting between the rotating shaft 42 and the locking slider 44, and further enhance the stability of the adjuster 4.

Furthermore, in the embodiment in which the first locking member 61 is the hook protruding toward the cover 2, and the cover 2 is provided with the through hole 214, the mounting portion is further provided with a locking sliding groove 215 communicated with the through hole 214 and used to limit the sliding of the locking slider 44, and the locking sliding groove 215 is communicated with the rotation groove 211. After the adjuster 4 is mounted on the cover 2, when the cover 2 closes the opening, the first locking member 61 enters the locking sliding groove 215 from the through hole 214 to lock with the second locking member 62. Certainly, the present invention is not limited to this in this regard. It may be understood that when the second locking member 62 is a hook protruding toward the housing 1, a through slot communicated with the locking sliding groove 215 and communicated with the locking sliding groove 215 in the extension direction may be additionally provided. After the locking slider 44 is mounted in the locking sliding groove 215, the second locking member 62 is located in the through slot. During the up-down movement of the locking slider 44, the second locking member 62 synchronously moves up and down along the through slot to switch between the locked position and the unlocked position.

Furthermore, in the embodiment where the first locking member 61 is the hook projecting toward the cover 2 and the second locking member 62 is the catching block, a side of the second locking member 62 close to the housing 1 is flush with a side of the locking slider 44 close to the housing 1, thereby reducing the width of the locking sliding groove 215 in the front-rear direction and thinning the cover 2.

Furthermore, the second driver 45 is an elastic member. More specifically, the second driver 45 is a spring. The spring is located between the locking slider 44 and the locking sliding groove 215. When the handle 41 is turned to drive the second locking member 62 to move towards the unlocked position, the spring is in a compressed state. After the handle 41 is released, the second locking member 62 returns to the locked position under the action of the elastic recovery force of the spring, and synchronously drives the handle 41 to return due to the cooperation of the first guide portion 441 and the second guide portion 422.

In the vacuum storage device 100 in the present embodiment, when the cover 2 closes the housing 1 and the cover 2 needs to be opened, the handle 41 is manually turned, and the second guide portion 422 and the first guide portion 441 cooperate with each other to drive the locking slider 44 to drive the second locking member 62 away from the first locking member 61. At the same time, the second guide block 421 cooperates with the first guide block 3322 to drive the pressure relief slider 332 to get close to the sealing plug 32, so as to unlock the cover 2 while relieving the pressure; After the cover 2 is opened, the handle 41 is released, the second locking member 62 returns under the action of the second driver 45, and the pressure relief slider 332 returns under the action of the first driver 43; when the cover 2 needs to be closed, the cover 2 is pushed back directly. Under the pressure of the first locking member 61, the second locking member 62 moves towards the locked position. When the second locking member 62 goes beyond the hook of the first locking member 61, the second locking member 62 is driven to move to the locked position to achieve locking under the action of the second driver 45.

Furthermore, the present invention further provides a refrigerator (not shown). The refrigerator comprises a refrigeration compartment and the above-mentioned vacuum storage device 100 located in the refrigeration compartment. The vacuum storage device 100 is the vacuum storage device 100 described above, and will not be described in detail any more here.

To conclude, in the vacuum storage device 100 in the present invention, the pressure relief slider 332 is driven so that the insertion portion 3321 of the slider is inserted into the edge of the sealing portion 322, thereby opening the pressure relief hole 31 to realize pressure relief. The sealing portion 322 covers the pressure relief hole 31 in its natural state and is not affected by an external force. That is to say, only when the pressure relief is needed and the adjuster 4 is operated to act upon the sealing portion 322 will the sealing portion 322 open the pressure relief hole 31 to realize the pressure relief, with a simple structure and a good sealing effect.

It should be understood that although the description is described according to the embodiments, not every embodiment only comprises one independent technical solution, that such a description manner is only for the sake of clarity, that those skilled in the art should take the description as an integral part, and that the technical solutions in the embodiments may be suitably combined to form other embodiments understandable by those skilled in the art.

The detailed descriptions set forth above are merely specific illustrations of feasible embodiments of the present invention, and are not intended to limit the scope of protection of the present invention. All equivalent embodiments or modifications that do not depart from the art spirit of the present invention should fall within the scope of protection of the present invention.

What is claimed is:

1. A vacuum storage device, comprising:

a housing with a storage cavity configured to be evacuated;

a cover cooperating with the housing to open or close the storage cavity;

a seal disposed between the housing and the cover;

a pressure relief assembly for relieving the pressure in the storage cavity; and an adjuster located on the housing or the cover;

wherein the pressure relief assembly comprises:

a pressure relief hole communicated with the storage cavity;

a sealing plug having a sealing portion for sealing the pressure relief hole;

a pressure relief element comprising a fixed base, a pressure relief slider slidingly attached to the fixed base, where an end of the pressure relief slider close to the sealing plug is provided with an insertion portion enabling the sealing portion to open the pressure relief hole at an edge of the sealing portion, a first guide block is disposed on the pressure relief slider, and both the pressure relief element and the pressure relief hole are located on the cover or the housing;

the adjuster drives the pressure relief slider to get close to or away from the sealing plug;

the adjuster comprises:

a handle;

a rotating shaft fixed with the handle and provided with a second guide block cooperating with the first guide block, where when the handle drives the rotating shaft to rotate, the second guide block and the first guide block cooperate with each other to drive the pressure relief slider to move towards the sealing plug;

a first driver disposed between the pressure relief slider and the fixed base, where after the pressure relief slider moves towards the sealing plug, the first driver drives the pressure relief slider to return.

2. The vacuum storage device according to claim 1, wherein the sealing plug further comprises a fixing portion fixed to a selective one of the cover and the housing wherein the selective one of the cover and the housing is provided with the pressure relief hole, and the sealing portion is connected with the fixing portion; the pressure relief slider and the pressure relief hole are on the same side of the fixing portion.

3. The vacuum storage device according to claim 1, wherein a thickness of the insertion portion gradually increases from an end of the insertion portion close to the sealing portion to the other end away from the sealing portion.

4. The vacuum storage device according to claim 1, wherein the fixed base has a guide structure extending towards the sealing plug, and a connecting portion located at an end of the guide structure away from the sealing plug; the pressure relief slider has a sliding structure cooperating with the guide structure to guide the pressure relief slider to get close to or away from the sealing plug, and both ends of the first driver are respectively fixed on the connecting portion and the sliding structure.

5. The vacuum storage device according to claim 4, wherein the guide structure is a guide groove, and at least part of the sliding structure can extend into the guide groove; or, the guide structure is a guide bar, and the sliding structure has a guide groove cooperating with the guide bar.

6. The vacuum storage device according to claim 1, wherein the cover or housing provided with the adjuster is provided with a rotation groove for receiving part of the rotating shaft, a handle cavity communicated with the rotation groove and configured to receive the handle, and a stopper cooperating with the rotation groove and configured to prevent the rotating shaft from disengaging.

7. The vacuum storage device according to claim 1, wherein a filter is disposed at a position on an inner side of the vacuum storage device corresponding to the pressure relief hole.

8. The vacuum storage device according to claim 1, wherein the pressure relief assembly and the adjuster are both disposed on the cover, and the pressure relief element and the adjuster are located on a side of the cover away from the housing.

9. The vacuum storage device according to claim 1, wherein the adjuster is disposed on the cover; the vacuum storage device further comprises a locking assembly that locks the cover with the housing, the locking assembly comprises a first locking member disposed on the housing, a second locking member disposed on the cover and cooperating with the first locking member, and the adjuster drives the second locking member to unlock from the first locking member while driving the pressure relief slider to get close to the sealing plug.

10. The vacuum storage device according to claim 9, wherein adjuster comprises:

a locking slider slidably connected to the cover and fixed with the second locking member, and the locking slider is provided with a first guide portion;

the rotating shaft being provided with a second guide portion cooperating with the first guide portion, when the handle drives the rotating shaft to rotate, the second guide portion and the first guide portion cooperate with each other to drive the locking slider to drive the second locking member away from the first locking member.

11. A refrigerator, comprising a refrigeration compartment, wherein the refrigerator further comprises the vacuum storage device according to claim 1 disposed in the refrigeration compartment.

* * * * *